United States Patent [19]

Sears

[11] 4,248,067

[45] Feb. 3, 1981

[54] DEVICE LOCK ALLOWING ROTATION

[75] Inventor: Hartley M. Sears, Costa Mesa, Calif.

[73] Assignee: Schick Laboratories, Inc., Los Angeles, Calif.

[21] Appl. No.: 7,977

[22] Filed: Jan. 31, 1979

[51] Int. Cl.[3] ..... E05B 73/00

[52] U.S. Cl. ..... 70/58; 70/63

[58] Field of Search ..... 70/32, 33, 34, 63, 23, 70/57, 58

[56] References Cited

U.S. PATENT DOCUMENTS

| | | | |
|---|---|---|---|
| 1,695,696 | 12/1928 | Page | 70/34 |
| 2,099,635 | 11/1937 | Toniolo | 70/63 |
| 2,660,872 | 12/1953 | Beach | 70/32 |
| 3,946,581 | 3/1976 | Weeks | 70/32 |

*Primary Examiner*—Robert L. Wolfe

*Attorney, Agent, or Firm*—Spensley, Horn, Jubas & Lubitz

[57] ABSTRACT

A locking apparatus for removably attaching an object to a specified place on a surface, allowing the object to rotate while locked. An engageable cylindrical protrusion is attached to the surface. The object is provided with a hole at the desired point of attachment, the hole allowing for the entrance of the cylindrical protrusion. The interior of the object contains a member connected to a lock cylinder which is rotatable between a locked and unlocked position. In the locked position, the member engages the protrusion and locks the object to the surface in a manner to allow rotation of the object about the protrusion.

3 Claims, 1 Drawing Figure

DEVICE LOCK ALLOWING ROTATION

BACKGROUND OF THE INVENTION

1. Field of the Invention

The herein disclosed invention relates to an apparatus for locking an object to a surface which allows the object to rotate about the point of affixation.

2. Prior Art

It is a universal problem to provide convenient accessability to certain small objects, yet insure that they are not misplaced, stolen, dropped or otherwise made unavailable for continued use. Even if such an object is meant to be used by only a restricted group of people, there is always present the possibility of theft, especially if the device has significant intrinsic value.

There have been many attempted solutions to this problem. For instance, an object may be permanently fastened to a larger surface, making it no more moveable than that of the surface to which it is affixed. Such a solution has the obvious disadvantage in that it may make use of the object appreciably less convenient. It may unduly restrict movement of the object by various users, and may hinder repair or replacement of the object.

A variety of solutions to this problem provide for a lockable securing apparatus, which allow for the convenient attachment and disattachment of the object to a larger surface. Depending on the particular apparatus used to lock the object, the apparatus may make use of the object appreciably less convenient. In addition, such apparatus may require an expensive or complicated attachment point or "cradle" to be provided on the attaching surface.

It is an objective of the herein disclosed invention to provide a locking apparatus which can be used to attach a wide range of objects to a surface, yet allow for the easy removal of the object when so desired. Additionally, it is an objective of the invention to permit the object, when locked to the surface, to be rotatable about the point of attachment, thereby allowing use of the object in a variety of directions. Additionally, it is an objective of the invention to be able to accommodate existing commercially available lock cylinders in providing a secure locking of an object.

SUMMARY OF THE INVENTION

These and other objectives are provided for by an apparatus which provides a generally circular protrusion to be attached to a surface. The protrusion contains a groove along its circumference. Inside the object is a flange having a cut out section. The flange is connected to a lock cylinder and rotatable between a locked and unlocked position. When in the locked position, the flange engages the protrusion from the surface by entering the groove, locking the object to the surface. When rotated to the unlocked position, the flange no longer engages the protrusion due to the cut out portion, permitting removal of the object.

DETAILED DESCRIPTION OF THE PREFERRED EMBODIMENT

Figure 1:
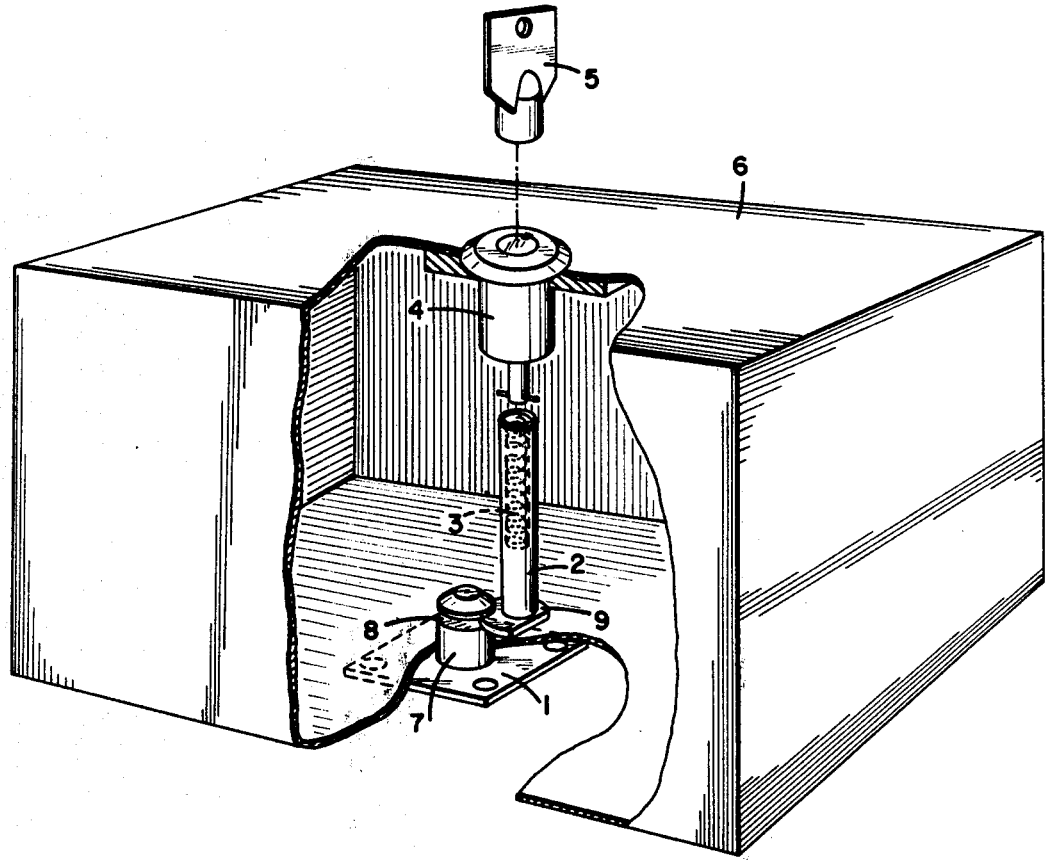
FIG. 1 is a perspective view, partially broken away, of an embodiment of the invention.

In FIG. 1, an object 6 is provided with an apparatus according to the herein disclosed invention which permits it to be lockably attached to a surface. Although the object 6 is illustrated as having generally rectangular shape, the invention should not be limited to use with objects having such a shape since the teachings of the invention extend to an arbitrarily shaped object 6.

In one embodiment of the invention, the object 6 was an electrical device housed in a metal box. The device was small in size, light in weight, had significant intrinsic value and contained a proprietary circuit design. It was necessary to use the device in a place where it could be easily stolen, yet it could not be protected in a manner which would interfere with the proper use of it. Furthermore, when in use, it was necessary that it be easily and readily rotatable on a surface to face any of a number of users.

The object 6 is provided with a lock cylinder 4 having a key 5. The lock cyllinder 4 and associated key 5 may be any of such devices commercially available, and are not part of the teachings of this invention. In the embodiment illustrated in FIG. 1, the lock cylinder 4 contains an extension from it into the interior of the object 6. The extension contains a pin through the extension. The extension is rotatable between a locked position and unlocked position in accordance with the movement of the key 5 in the lock cylinder 4.

The invention provides for a member 1 which may be securely affixed to any desired surface. The member 1 has a generally cylindrical protrusion 7, which projects in a generally normal direction from the surface when the member 1 is attached to the surface. Around the circumference of the cylinder 7 is provided a groove 8.

When the member 1 is affixed to a surface, the object 6 may be placed over the cylinderical protrusion 7 via a hole in the outer surface of the object 6. This hole, not illustrated in FIG. 1 due to the partial break out of the object 6, is located at the point where the object 6 is desired to be affixed to the surface. The hole also determines the point of rotation of the object 6 about the cylinderical protrusion 7.

The herein disclosed invention also provides for a rod-like member 2 which is engagable with the extension of the lock cylinder 4. FIG. 1 illustrates one possible method for performing this engagement. The rod-like member 2 contains a blind bore through one axial end of sufficient size to allow partial insertion of the extension from the lock cylinder 4. In addition, the rod-like member 2 contains a slot across the axial end containing the blind bore sufficient to allow insertion of the pin of the lock cylinder 4 into the slot. In this manner the extention of the lock cylinder 4 suitably engages the rod-like member 2.

At the opposite end of the rod-like member 2 is a flange 9. This flange has a cut out section formed by a plane parallel to the axis of the rod-like member 2. The effect of this section is to give the flange 9 an appearance of a "flat spot". The flange is rotatable in cooperation with the extension from the key cylinder 4 and when the cylindrical protrusion 7 is inserted into the device 6, the flange engages the protrusion 7 when the flange is moved to its locked position. The engagement is caused by the flange 9 entering the groove 8 of the protrusion 7 thereby preventing the protrusion from being removed from the hole. In this way, the object 6 is firmly attached to the desired surface. The object 6 may be easily rotated about the cylindrical protrusion 7 to which it is locked due to the circular nature of the protrusion 7 and groove 8. When the rod-like member 2 is rotated into its unlocked position, the flange 9 no longer engages the protrusion 7 due to the cut out section of the flange 9. In this manner the object 6 may be easily removed from the surface.

In one embodiment of the invention, the rod-like member 2 is held in position via a bias spring 3 which is contained within a blind bore of the rod-like member 2 and is biased against the extension of the lock cylinder 4. The object 6 contains a second hole into which the rod-like member 2 may be partially inserted, positioning the rod-like member by it being retained on one end by the hole and on the opposite end by the extension of the lock cylinder 4.

In one embodiment of the invention, the cylindrical protrusion 7 is capped at the axial end which enters the hole of the object 6, with a truncated cone-like shape. Such a shape is desirable inasmuch as it aids in the positioning of the object 6 over the protrusion 7, and for the more ready affixing of the object 6 to the desired surface.

While only a limited number of embodiments of the invention have been discussed herein, it is realized that those skilled in the art may make changes or modifications in the invention without departing from the true scope and spirit of it. Therefore, the scope and spirit of the invention should not be limited to the embodiments discussed, but only by the invention as claimed.

I claim:

1. A locking apparatus for use in removably attaching an object having an outer shell to a specified place on a surface, said object containing a lock cylinder opposite the desired point of attachment, said lock cylinder having an extension from it into the interior of said object, said extension able to be moved into a lock position and an unlock position, comprising:

a hole through said outer shell at the desired point of attachment of said object to said surface;

surface securing means, fastened to said surface at said specified place, having an engagable protrusion from said surface of generally cylindrical shape and able to be inserted into the interior of said object through said hole;

engagement means, connectable to said extension and rotatable in cooperation with said extension between a lock position and an unlock position, for engaging said surface securing means when said engagement means is moved to said lock position while said protrusion is inserted in said hole, and for permitting the rotational engagement of said object around said protrusion;

wherein said protrusion is able to be securely fastened to said surface in a position normal to said surface, and has a groove about its circumference near the axial end opposite said surface; and wherein said engagement means comprises a generally circular flange with a section removed, said section formed by a cut parallel to the axis of said flange, said flange rotatable in cooperation with said extension between said lock and unlock positions, said lock position causing said flange to engage said protrusion by entering said groove, thereby preventing said protrusion from being withdrawn from said hole, said unlock position causing said flange to not engage said protrusion due to said removed section, thereby permitting the removal of said object from said surface.

2. An apparatus according to claim 1 wherein said protrusion terminates in a truncated cone at the axial end opposite said surface, thereby assisting in the positioning of said object to allow insertion of said protrusion into said object.

3. A locking apparatus for use in removably attaching an object having an outer shell to a specified place on a surface, said object containing a lock cylinder opposite the desired point of attachment, said lock cylinder having an extension from it into the interior of said object, said extension able to be moved into a lock position and an unlock position, comprising:

a hole through said outer shell at the desired point of attachment of said object to said surface;

surface securing means, fastened to said surface at said specified place, having an engagable protrusion from said surface of generally cylindrical shape and able to be inserted into the interior of said object through said hole;

engagement means, connectable to said extension and rotatable in cooperation with said extension between a lock position and an unlock position, for engaging said surface securing means when said engagement means is moved to said lock position while said protrusion is inserted in said hole, and for permitting the rotational engagement of said object around said protrusion;

wherein said extension comprises a rod-like member which rotates about its axis between said lock and unlock positions, said member having a pin through it in the plane of said rotation; and said engagement means comprises a cylinder with at one axial end a bind bore into said end and slot across said end, said bore allowing partial insertion of said rod-like member and said slot permitting said pin to engage said cylinder, said blind bore and slot thereby providing for the rotatable engagement of said engagement means with said extension.

* * * * *